US008864874B2

(12) United States Patent
Chen et al.

(10) Patent No.: US 8,864,874 B2
(45) Date of Patent: Oct. 21, 2014

(54) METHOD FOR PREPARING SPONGE TITANIUM FROM SODIUM FLUOTITANATE BY ALUMINOTHERMIC REDUCTION

(75) Inventors: Xuemin Chen, Guangdong (CN); Jun Yang, Guangdong (CN); Zhi Zhou, Guangdong (CN)

(73) Assignee: Shenzhen Sunxing Light Alloys Materials Co., Ltd., Shenzhen, Guangdong (CN)

( * ) Notice: Subject to any disclaimer, the term of this patent is extended or adjusted under 35 U.S.C. 154(b) by 147 days.

(21) Appl. No.: 13/585,786

(22) Filed: Aug. 14, 2012

(65) Prior Publication Data

US 2012/0304826 A1 Dec. 6, 2012

(30) Foreign Application Priority Data

Jan. 18, 2012 (CN) ..... 2012 1 0014937

(51) Int. Cl.
*C22B 34/00* (2006.01)
*C22B 34/12* (2006.01)

(52) U.S. Cl.
CPC ..... *C22B 34/1277* (2013.01)
USPC ..... 75/615; 75/620

(58) Field of Classification Search
CPC ..... C22B 34/1222; C22B 34/1231; C22B 34/1268; C22B 34/1277
USPC ..... 75/615, 620
See application file for complete search history.

(56) References Cited

U.S. PATENT DOCUMENTS 4,390,365 A * 6/1983 Hard et al. ..... 75/419

* cited by examiner

*Primary Examiner* — George Wyszomierski
*Assistant Examiner* — Tima M McGuthry Banks
(74) *Attorney, Agent, or Firm* — Jackson IPG PLLC

(57) ABSTRACT

The invention provides a method for preparing sponge titanium from sodium fluotitanate by aluminothermic reduction, comprising the following steps: a reaction step: aluminum and zinc are mixed under a vacuum state, and sodium fluotitanate is then added into the mixture for reaction; a separation step: the product resulting from the complete reaction stands still and is then introduced with inert gas, and NaF and $AlF_3$ in upper-layer liquid phase are extracted; and a distillation step: Zn in the remaining product Zn—Ti is distilled out under a vacuum state, wherein the mass ratio of the aluminum to the zinc is 1:2 to 1:10.

10 Claims, No Drawings

METHOD FOR PREPARING SPONGE TITANIUM FROM SODIUM FLUOTITANATE BY ALUMINOTHERMIC REDUCTION

TECHNICAL FIELD OF THE INVENTION

The invention relates to a method for preparing sponge titanium from sodium fluotitanate by aluminothermic reduction, more particularly to a method for preparing sponge titanium from sodium fluotitanate by aluminothermic reduction, which has the advantages of low cost, high efficiency and continuous operation.

BACKGROUND OF THE INVENTION

The sponge titanium production processes that have been well-known domestically and overseas mainly include: metallothermic reduction process, electrolysis process, direct thermolysis process and electronically mediated reaction process, etc., and the typical raw materials include titanium chloride ($TiCl_4$, $TiI_4$), titanium oxide ($TiO_2$) and titanium compounds ($K_2TiF_6$, $Na_2TiF_6$). Among various sponge titanium production processes, the traditional titanium tetrachloride aluminum-magnesium thermal reduction process (Kroll process), though mature and industrialized, has complex process and high cost and is pollutant to environment, thus limiting its further application and popularization. The method for preparing sponge titanium from sodium fluotitanate by metallothermic reduction process is a production method which is continuous, low in cost and high in efficiency and can settle plenty of problems in the traditional process efficiently, however, there are only a few domestic and overseas reports, and so far, a successful industrialization case has not been found yet.

SUMMARY OF THE INVENTION

The invention provides a method for preparing sponge titanium from sodium fluotitanate by aluminothermic reduction, Proposal 1: method for preparing titanium from sodium fluotitanate by aluminothermic reduction process:

The equation related is as follows: $3Na_2TiF_6+4Al=3Ti+6NaF+4AlF_3$

Proposal 2: method for preparing sponge titanium from sodium fluotitanate by magnesiothermic reduction process:

The equations related are as follows:

$$3Na_2TiF_6+4Al=3Ti+6NaF+4AlF_3$$

$$Na_2TiF_6+2Mg=Ti+2MgF_2+2NaF$$

The method comprises the following steps:

a reaction step: aluminum and zinc are mixed under a vacuum state, and the mixture is then reacted with sodium fluotitanate;

a separation step: inert gas is introduced after complete reaction, and NaF and $AlF_3$ in upper-layer liquid phase are extracted;

and a distillation step: Zn in the remaining product is distilled out under a vacuum state;

wherein the mass ratio of the aluminum to the zinc is 1:2 to 1:10.

Preferably, the reaction temperature in the reaction step is 1000° C.

Preferably, the liquid phase extraction temperature in the separation step is 1050° C.

Preferably, the distillation temperature in the distillation step is 1000° C.

The invention further provides another method for preparing sponge titanium from sodium fluotitanate by aluminothermic reduction, comprising the following steps:

a reaction step: aluminum, zinc and magnesium are mixed under a vacuum inert gas introduction condition, and sodium fluotitanate is then added into the mixture for reaction;

a separation step: inert gas is introduced after complete reaction, and NaF, $AlF_3$ and $MgF_2$ in upper-layer liquid phase are extracted;

and a distillation step: Mg and Zn in the remaining product are distilled out under a vacuum state;

wherein the mass ratio of the aluminum to the zinc to the magnesium is 18:108:1 to 1:6:1.

Preferably, the reaction temperature in the reaction step is 950° C.

Preferably, the liquid phase extraction temperature in the separation step is 1050° C.

Preferably, the distillation temperature in the distillation step is 1100° C.

Preferably, the vacuum degree in the distillation step is at least 1 MPa.

The invention has the advantages that: by adopting the technical proposal discussed above, the method is short in technological flow, low in cost, harmless and environment-friendly compared with traditional processes, and rivals the prior art for the reduction rate and yield of sponge titanium, furthermore, the final resultant sponge titanium can be directly applied to technological production, further saving resources and cost.

DETAILED DESCRIPTION OF THE PREFERRED EMBODIMENTS

The preferred embodiments of the invention will be described below in further details:

Proposal 1: method for preparing sponge titanium from sodium fluotitanate by aluminothermic reduction process based on zinc matrix:

The equation related is as follows: $3Na_2TiF_6+4Al=3Ti+6NaF+4AlF_3$

Embodiment 1: 36 g aluminum and 72 g zinc are mixed under a vacuum state, and the mixture is then reacted with 240 g sodium fluotitanate at 1000° C.;

the product stands still after complete reaction and is then introduced with inert gas, and NaF and $AlF_3$ liquid phases in upper layer are extracted at 1050° C.;

under the state of high vacuum and 1000° C., Zn in the remaining product is distilled out to obtain 45.01 g sponge titanium; the titanium content in the product is 87.76% and the reduction rate is 82.3%.

Embodiment 2: 36 g aluminum and 144 g zinc are mixed under a vacuum state, and the mixture is then reacted with 240 g sodium fluotitanate at 1000° C.;

the product stands still after complete reaction and is then introduced with inert gas, and NaF and $AlF_3$ liquid phases in upper layer are extracted at 1050° C.;

under the state of high vacuum and 1000° C., Zn in the remaining product is distilled out to obtain 48.22 g sponge titanium; the titanium content in the product is 92.07% and the reduction rate is 92.5%.

Embodiment 3: 36 g aluminum and 216 g zinc are mixed under a vacuum state, and the mixture is then reacted with 240 g sodium fluotitanate at 1000° C.;

the product stands still after complete reaction and is then introduced with inert gas, and NaF and $AlF_3$ liquid phases in upper layer are extracted at 1050° C.;

under the state of high vacuum and 1000° C., Zn in the remaining product is distilled out to obtain 49.04 g sponge titanium; the titanium content in the product is 92.29% and the reduction rate is 95%.

Embodiment 4: 36 g aluminum and 288 g zinc are mixed under a vacuum state, and the mixture is then reacted with 240 g sodium fluotitanate at 1000° C.;

the product stands still after complete reaction and is then introduced with inert gas, and NaF and $AlF_3$ liquid phases in upper layer are extracted at 1050° C.;

under the state of high vacuum and 1000° C., Zn in the remaining product is distilled out to obtain 50.26 g sponge titanium; the titanium content in the product is 90.92% and the reduction rate is 95.2%.

Embodiment 5: 36 g aluminum and 360 g zinc are mixed under a vacuum state, and the mixture is then reacted with 240 g sodium fluotitanate at 1000° C.;

the product stands still after complete reaction and is then introduced with inert gas, and NaF and $AlF_3$ liquid phases in upper layer are extracted at 1050° C.;

under the state of high vacuum and 1000° C., Zn in the remaining product is distilled out to obtain 49.7 g sponge titanium; the titanium content in the product is 92.14% and the reduction rate is 95.4%.

Embodiment 6: 36 g aluminum, 216 g zinc and 36 g magnesium are mixed under a vacuum inert gas introduction condition, and the mixture is then reacted with 240 g sodium fluotitanate at 950° C.;

the product stands still after complete reaction and is then introduced with inert gas, and NaF, $MgF_2$ and $AlF_3$ liquid phases in upper-layer liquid phase are extracted at 1050° C.;

under the state of high vacuum and 1100° C., Mg and Zn in the remaining product are distilled out to obtain 48.36 g sponge titanium; the titanium content in the product is 92.7% and the reduction rate is 93.4%.

Embodiment 7: 36 g aluminum, 216 g zinc and 18 g magnesium are mixed under a vacuum inert gas introduction condition, and the mixture is then reacted with 240 g sodium fluotitanate at 950° C.;

the product stands still after complete reaction and is then introduced with inert gas, and NaF, $MgF_2$ and $AlF_3$ liquid phases in upper-layer liquid phase are extracted at 1050° C.;

under the state of high vacuum and 1100° C., Mg and Zn in the remaining product are distilled out to obtain 47.8 g sponge titanium; the titanium content in the product is 92.78% and the reduction rate is 92.4%.

Embodiment 8: 36 g aluminum, 216 g zinc and 9 g magnesium are mixed under a vacuum inert gas introduction condition, and the mixture is then reacted with 240 g sodium fluotitanate at 950° C.;

the product stands still after complete reaction and is then introduced with inert gas, and NaF, $MgF_2$ and $AlF_3$ liquid phases in upper-layer liquid phase are extracted at 1050° C.;

under the state of high vacuum and 1100° C., Mg and Zn in the remaining product are distilled out to obtain 47.91 g sponge titanium; the titanium content in the product is 94.88% and the reduction rate is 94.7%.

Embodiment 9: 36 g aluminum, 216 g zinc and 2 g magnesium are mixed under a vacuum inert gas introduction condition, and the mixture is then reacted with 240 g sodium fluotitanate at 950° C.;

TABLE 1

Test Data

| Embodiment | Addition Amount of Raw Materials, g | | | Theoretical Amount of Ti, g | Actual Rough Titanium Product, g | Ti Content In Product, % | Reduction Rate, % |
|---|---|---|---|---|---|---|---|
| | $Na_2TiF_6$ | Al | Zn | | | | |
| 1 | 240 | 36 | 72 | 48 | 45.01 | 87.76 | 82.3 |
| 2 | 240 | 36 | 144 | 48 | 48.22 | 92.07 | 92.5 |
| 3 | 240 | 36 | 216 | 48 | 49.4 | 92.29 | 95.0 |
| 4 | 240 | 36 | 288 | 48 | 50.26 | 90.92 | 95.2 |
| 5 | 240 | 36 | 360 | 48 | 49.7 | 92.14 | 95.4 |

Reduction Rate (%) = (Actual Sponge Titanium Product × Ti Content In Product)/Theoretical Amount of Ti Proposal 2: method for preparing sponge titanium from sodium fluotitanate by aluminothermic reduction process based on zinc-magnesium matrix:

The equations related are as follows:

$$3Na_2TiF_6+4Al=3Ti+6NaF+4AlF_3$$

$$Na_2TiF_6+2Mg=Ti+2MgF_2+2NaF$$

the product stands still after complete reaction and is then introduced with inert gas, and NaF, $MgF_2$ and $AlF_3$ liquid phases in upper-layer liquid phase are extracted at 1050° C.;

under the state of high vacuum and 1100° C., Mg and Zn in the remaining product are distilled out to obtain 46.3 g sponge titanium; the titanium content in the product is 98.79% and the reduction rate is 95.3%.

TABLE 2

| Test Data | | | | | | | | |
|---|---|---|---|---|---|---|---|---|
| | Addition Amount of Raw Materials, g | | | | Theoretical Amount of | Actual Rough Titanium | Ti Content In Product, | Reduction |
| Embodiment | $Na_2TiF_6$ | Al | Zn | Mg | Ti, g | Product, g | % | Rate, % |
| 6 | 240 | 36 | 216 | 36 | 48 | 48.36 | 92.7 | 93.4 |
| 7 | 240 | 36 | 216 | 18 | 48 | 47.8 | 92.78 | 92.4 |
| 8 | 240 | 36 | 216 | 9 | 48 | 47.91 | 94.88 | 94.7 |
| 9 | 240 | 36 | 216 | 2 | 48 | 46.3 | 98.79 | 95.3 |

Further detailed descriptions are made to the invention with reference to the preferred embodiments in the above discussions and it could not be considered that the embodiments of the invention are limited to these descriptions only. Many simple derivations or alternations could be made without departing from the concept of the invention by ordinary skilled in this art to which the invention pertains, and shall be contemplated as being within the scope of the invention.

What is claimed is:

1. A method for preparing sponge titanium from sodium fluotitanate by aluminothermic reduction, characterized in that, the method comprises the following steps:

a reaction step: aluminum and zinc are mixed under a vacuum state, and sodium fluotitanate is then added into a mixture for reaction;

a separation step: inert gas is introduced after complete reaction, and NaF and $AlF_3$ in upper-layer liquid phase are extracted; and a distillation step: Zn in a remaining product is distilled out under a vacuum state;

wherein a mass ratio of the aluminum to the zinc is 1:2 to 1:10.

2. The method for preparing sponge titanium according to claim 1, wherein a reaction temperature in the reaction step is 800° C.

3. The method for preparing sponge titanium according to claim 1, wherein a liquid phase separation temperature in the distillation step is 1050° C.

4. The method for preparing sponge titanium according to claim 1, wherein a distillation temperature in the distillation step is 1000° C.

5. The method for preparing sponge titanium according to claim 1, wherein a vacuum degree in the distillation step is 1 MPa.

6. A method for preparing sponge titanium from sodium fluotitanate by aluminothermic reduction, characterized in that, the method comprises the following steps:

a reaction step: aluminum, zinc and magnesium are mixed under a vacuum inert gas introduction condition to form a mixture, and sodium fluotitanate is then added into the mixture for reaction;

a separation step: inert gas is introduced after complete reaction, and NaF, $AlF_3$ and $MgF_2$ in upper-layer liquid phase are extracted; and a distillation step: Mg and Zn in a remaining product are distilled out under a vacuum state;

wherein a mass ratio of the aluminum to the zinc to the magnesium is 18:108:1 to 1:6:1.

7. The method for preparing sponge titanium according to claim 6, wherein a reaction temperature in the reaction step is 950° C.

8. The method for preparing sponge titanium according to claim 6, wherein a liquid phase separation temperature in the distillation step is 1050° C.

9. The method for preparing sponge titanium according to claim 6, wherein a distillation temperature in the distillation step is 1100° C.

10. The method for preparing sponge titanium according to claim 6, wherein a vacuum degree in the distillation step is 1 MPa.

* * * * *